United States Patent [19]

Korner

[11] 4,456,440

[45] Jun. 26, 1984

[54] VALVE ASSEMBLY FOR HIGH-PRESSURE PUMPS

[75] Inventor: Jorg P. Korner, Hagen, Fed. Rep. of Germany

[73] Assignee: Uhde GmbH, Dortmund, Fed. Rep. of Germany

[21] Appl. No.: 355,525

[22] Filed: Mar. 8, 1982

[30] Foreign Application Priority Data

Mar. 25, 1981 [DE] Fed. Rep. of Germany ..... 3111614

[51] Int. Cl.[3] ..... F04B 39/00; F04B 21/02

[52] U.S. Cl. ..... 417/540; 417/568

[58] Field of Search ..... 417/454, 567, 568, 540

[56] References Cited

U.S. PATENT DOCUMENTS

| | | | |
|---|---|---|---|
| 2,059,758 | 11/1936 | Stearns | 417/454 |
| 3,119,410 | 1/1964 | Noecker | 417/568 |
| 3,203,357 | 8/1965 | DeLorme | 417/568 |
| 3,206,110 | 9/1965 | Waibel | 417/567 |
| 3,309,013 | 3/1967 | Bauer | 417/567 |
| 3,309,014 | 3/1967 | Bauer et al. | 417/567 |
| 3,510,233 | 5/1970 | Strebal | 417/454 |

FOREIGN PATENT DOCUMENTS

| | | | |
|---|---|---|---|
| 2629206 | 1/1978 | Fed. Rep. of Germany | 417/568 |
| 127847 | 3/1927 | Switzerland | 417/567 |

*Primary Examiner*—William L. Freeh

*Attorney, Agent, or Firm*—Fraser, Barker, Purdue & Clemens

[57] ABSTRACT

The invention relates to a valve assembly for high-pressure pumps especially where pressures above 2,000 bars are concerned. The valve assembly for such high-pressure pumps consists of a distribution section, a suction valve, and a discharge valve. A surge vessel is provided in the discharge line in order to obtain a uniform operating pressure.

4 Claims, 2 Drawing Figures

VALVE ASSEMBLY FOR HIGH-PRESSURE PUMPS

BACKGROUND OF THE INVENTION

A valve assembly employed with a high-pressure pump is continuously subjected to changing pressure loads, which vary as a function of the number of strokes of an associated plunger. As the suction pressure of the pump generally equals the atmospheric pressure, load changes in the ratio of 2,000 to 1 or more are encountered. The components of the valve assembly can withstand such load changes only for a limited extent of time, i.e. the material from which the valve components are formed often fails after a short period of service. Replacement of the valve components of the valve assembly is very time-consuming and the operating period of the high-pressure pumps is relatively short.

SUMMARY OF THE INVENTION

The object of the present invention is to eliminate the disadvantages encountered with valve assemblies employed with current high-pressure pumps.

According to the present invention, the aforementioned problem is solved by arranging the valve assembly within a housing and providing a free space between the housing and a distribution section, adjacent a multipart suction valve and a multipart discharge valve, and by connecting this free space to the discharge line downstream of a surge vessel.

The advantages of the present invention include a valve comprised of components which can be produced with smaller wall thicknesses since smaller tensile load within the bore walls of the valve components is produced, thus essentially extending the operating period of the valve components.

The structural parts or components of the valve assembly are typically subjected to compression loads but the tensile load is much lower than previously experienced. By using the process fluid as a hydraulic agent, the need for additional facilities is reduced to a minimum as only a housing for the components of the valve assembly and a connection line between the housing and a surge vessel is required.

BRIEF DESCRIPTION OF THE DRAWINGS

An embodiment of the invention is illustrated in the accompanying drawings and described in more detail below when considered in the light of the drawings, in which.

DETAILED DESCRIPTION OF PREFERRED EMBODIMENT

Figure 1:
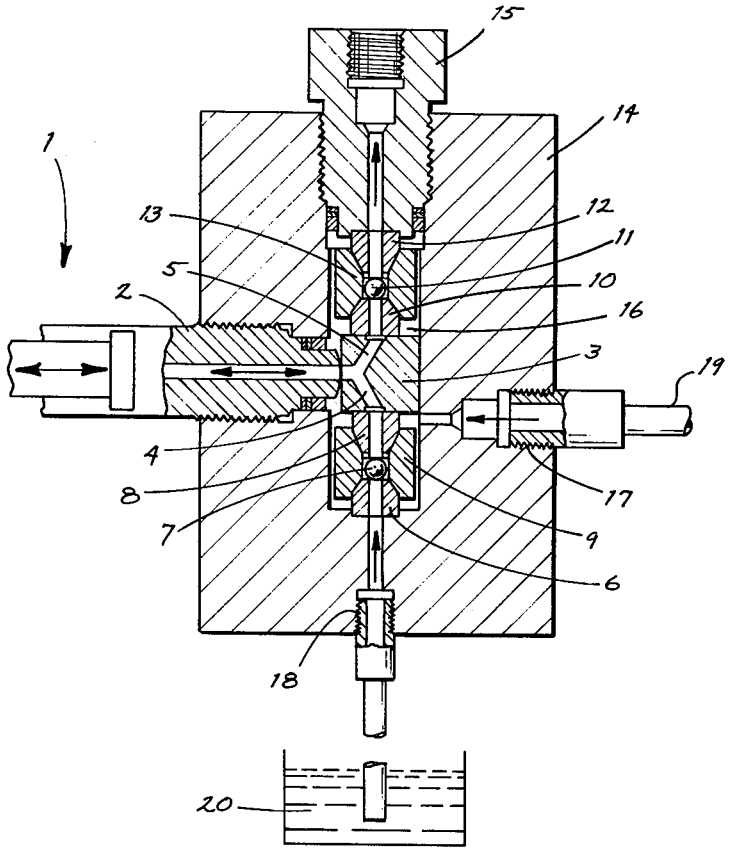
FIG. 1 is a cross sectional view of a valve assembly disposed within an associated housing.

Referring to FIG. 1, a high-pressure pump 1 is equipped with pump head 2 to which is connected a distribution section 3 having suction and discharge channels 4 and 5, respectively, of a valve assembly constructed in accordance with the invention. Located upstream of the suction channel 4 is a multipart suction valve 6 having a valve seat closed by a valve ball 7, and a slotted valve part 8 all of which are kept in place by a valve positioning ring 9. Located downstream of the discharge channel 5 is a multipart discharge valve 10 having a valve seat closed by a valve ball 11, and a slotted valve part 12, all of which are kept in place by a valve positioning ring 13. The suction and discharge valve components may be identical for ease of their manufacture and assembly.

According to the present invention, the distribution section 3, the multipart suction valve, and the multipart discharge valvve are disposed in a housing 14, separate from the pump 1. The pump head 2 and a pressure nozzle 15 are threaded and press distribution section 3 and the valve components to one another and against seats provided in housing 14 so that all fluid channels are absolutely tight. The outer dimensions of distribution section 3 and of the suction and discharge valve components are smaller than the bore provided for in the housing 14 for providing a free space 16. The housing 14 is provided with two additional bores, a bore 17 for connection of a return discharge line 19 and a bore 18 for connection of a suction line. The bore 17 is connected with the free space 16 surrounding the suction and discharge valve assemblies and the bore 18 is connected to the downstream side of the suction valve assembly.

Figure 2:
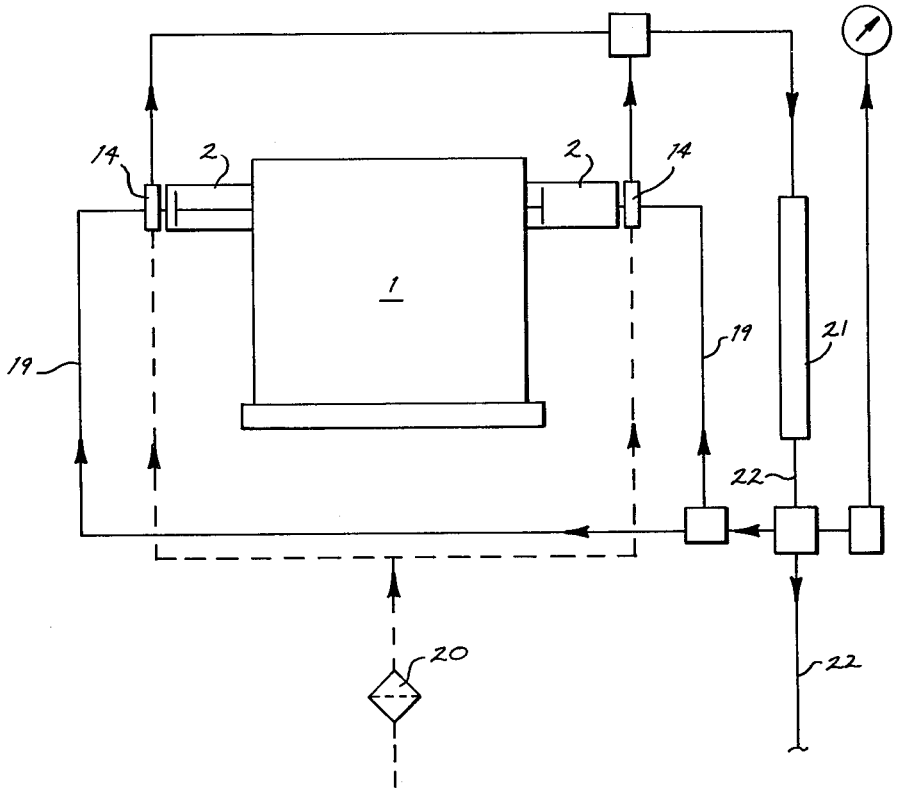
FIG. 2 is schematic view of a hydraulic system employing the valve assembly illustrated in FIG. 1.

The high-pressure pump 1 is generally equipped with several high-pressure cylinders and plungers in order to obtain as constant a pressure as possible in the discharge line of the hydraulic system shown in FIG. 2. Each high-pressure cylinder is provided with a valve assembly. Fluid is taken in from a fluid tank 20, is pressurized by the pump plungers, and thence directed through the discharge valves into the discharge line. After passing through a surge vessel 21 the fluid flows through line 22 to the point of consumption. Part of the fluid is drawn off from line 22 and directed to the free space 16 through line 19 connected to bore 17 in housing 14. Accordingly, hydraulic pressure is available in the free space 16 for acting on the suction valve, the distribution section 3, and the discharge valve. In this arrangement, the more uniform the pressure downstream of the surge vessel 21, the more uniform will be the pressure load on the valve parts and on the distribution section.

What is claimed is:

1. In a hydraulic system having a source of pumping energy, a surge vessel communicating with the discharge line of the system, and a valve assembly for directing the fluid flow wherein the improvement resides in the valve assembly comprising:

(a) a housing including passage means communicating with the source of the pumping energy, a fluid inlet, and a fluid outlet;

(b) a suction valve disposed in said passage means and communicating with the inlet of said housing;

(c) a discharge valve disposed in said passage means and communicating with the outlet of said housing;

(d) a distribution section disposed in said passage means between said suction valve and said discharge valve, and providing communication between the source of pumping energy and said suction valve and said discharge valve; said suction valve and said discharge valve and said distribution section cooperating to define a free space within the interior of said housing; and (e) means for effecting communication between the free space defined by said suction valve and said discharge valve and said distribution section, and the interior of said housing and the outlet of the surge vessel, whereby the pressure acting on said suction valve and said discharge valve within the interior of said housing is regulated by pressure downstream of the surge vessel.

2. The invention defined in claim 1 wherein said distribution section includes passage means to effect communication between said suction valve and said discharge valve and the source of pumping energy.

3. The invention defined in claim 1 wherein said distribution section includes passage means providing communication between the passage means, the fluid inlet, and the fluid outlet of said housing through said suction valve and said discharge valve, respectively.

4. The invention defined in claim 1 wherein said suction valve and said discharge valve are normally closed.

* * * * *